United States Patent [19]

Johnson et al.

[11] Patent Number: 4,532,175

[45] Date of Patent: Jul. 30, 1985

[54] COLLECTOR MEMBRANE

[75] Inventors: Ronald E. Johnson, Tioga, Pa.; Lawrence S. Rajnik, Corning; Lung-ming Wu, Horseheads, both of N.Y.

[73] Assignee: Corning Glass Works, Corning, N.Y.

[21] Appl. No.: 524,401

[22] Filed: Aug. 22, 1983

[51] Int. Cl.[3] ..... B41F 17/00

[52] U.S. Cl. ..... 428/220; 428/447; 101/41; 101/35

[58] Field of Search ..... 101/41, 35; 428/447, 428/220, 332, 338, 339

[56] References Cited

U.S. PATENT DOCUMENTS 3,554,836 1/1971 Steindorf ..... 101/35 X
3,756,156 9/1973 Valiela ..... 101/41 X
3,868,901 3/1975 Valiela ..... 101/41
3,871,293 3/1975 Valiela ..... 101/41

OTHER PUBLICATIONS

IBM Tech. Disc., Rotary Indexed Printing Plate, IBM 1978, 3620, vol. 20, No. 9, 2/78.

*Primary Examiner*—George F. Lesmes
*Assistant Examiner*—Nancy A. B. Swisher
*Attorney, Agent, or Firm*—B. R. Turner

[57] ABSTRACT

In a printing apparatus using a collector membrane, certain formulations of room temperature vulcanizing silicone materials form membranes with superior performance. The preferred release characteristic of the material is set forth in terms of the time it takes a test element to roll along an inclined plane having an adhesive material thereon.

3 Claims, No Drawings

COLLECTOR MEMBRANE

BACKGROUND OF THE INVENTION

A printing apparatus for decorating ware is disclosed in copending U.S. patent applications, Ser. Nos. 332,723 (now abandoned) and 332,726, filed Dec. 12, 1981 and U.S. patent application Ser. No. 419,471 (now U.S. Pat. No. 4,417,513), filed 9-17-82. The device includes a flexible membrane collector. Pressure-sensitive, thermoplastic inks, especially useful with such a device, are disclosed in copending U.S. patent application Ser. No. 419,196 (now abandoned), filed 9-17-82.

The present invention discloses a flexible membrane material having properties most preferred for quality print results.

SUMMARY OF INVENTION

There is disclosed a silicon membrane collector formed of room temperature vulcanizing rubber. The silicone membrane receives or collects, by intimate contact, a thermoplastic pressure-sensitive ink formulation in the form of one or more portions of a design. The design thus collected may be deposited onto another surface by intimate mechanical contact of the membrane therewith. The membrane may be between 0.2" and 0.02" thick, and is formulated to have a tensile strength of at least 50 psi, an elongation of at least 150% and a surface tack of between 120 and 1200 grams.

DESCRIPTION OF THE PREFERRED EMBODIMENTS

The present invention utilizes room temperature vulcanizing (RTV) silicones for a collector membrane. Such materials are generally divided into two classifications, each based upon a particular curing mechanism of the material. For example, materials known as addition-cure silicones contain silicone hydride cross-linkers which react with vinyl groups when mixed therewith. A platinum compound is used as a catalyst. There are no volatile by-products that are produced during the curing step. The curing proceeds evenly in deep sections and is heat acceleratable.

Another type, known as condensation-cure silicones, has a condensation reaction in which an alkoxy cross-linker reacts with a silanol group in the presence of a stanous soap as the catalyst. A volatile alcohol by-product evaporates as the reaction proceeds.

It is not entirely understood how the composition, the curing mechanism, the fillers and the degree of cross-linking affect the surface energy and surface tack. The surface energy and tack dictate and release properties of a silicone material. The condensation-cure silicones are often more releasing, because they generally appear to have a lower surface tack. Consequently, they are often used as the first transfer surface or offset surface in a multiple surface system. On the other hand, the addition-cure silicones are often less releasing and are generally used as the second transfer, i.e., a collector. The first surface picks up ink from a heated gravure plate for transfer to the second transfer surface or collector. Formulation parameters, other than the curing mechanism, also have significant affects on the release properties, and thus, condensation and addition types have overlapping characteristics.

It is known that any given silicone formulation may be made more releasing by adding dimethyl siloxane oil. Although the viscosity, as determined by molecular weight of the oil, is relatively unimportant, the higher viscosity oils are usually avoided because they cause the surface of the silicone to become greasy, and therefore susceptible to contamination. The release properties increase, that is the surface energy decreases, as the amount of oil is increased. A preferred viscosity range for the oil is between about 20 and 1000 centistokes.

At very high oil levels, the affect on durometer, which decreases with increasing oil content, may cancel any further improvement in the release characteristic of the material. Extreme values of durometer interfere with obtaining a favorable release. A high durometer silicone does not conform well to surfaces being printed, whereas a low durometer silicone makes it difficult to exert a sufficient transfer pressure. For these reasons, durometer is generally kept within a range of about 30–90 points, as measured on a Shore-OO durometer gauge, manufactured by Shore Instrument and Manufacturing Company. The most convenient or preferred working range of durometer is between 50–75 points. For a collector membrane, the oil may comprise from about 0 to 50% of the silicone formulation. A preferred oil content for a typical membrane formulated from Dow Corning Silastic L is between about 30 to 50 parts by weight. Table I shows that increasing the oil content of the silicone reduces the tack and durometer characteristics of Silastic L. In a prepared embodiment, 40 phr is added to the silicone (two Shore readings are given).

TABLE I

| Oil Addition (phr)* | Tack (grams) | Durometer Shore-A | Durometer Shore-00 |
|---|---|---|---|
| 0 | 579 | 35 | 78 |
| 20 | 338 | | |
| 40 | 250 | 10 | 62 |
| 60 | 207 | | |
| 80 | 164 | | |

*phr - parts by weight addition per hundred parts base resin

The membrane described herein may be prepared by injecting or pouring liquid unvulcanized material into a polished metal mold at room temperature. Thereafter, the material is allowed to cure at room temperature or is heat accelerated by curing in an oven at a temperature up to about 200° F. to form a cohesive body between about 0.02 and 0.20" thick. The material may be directly cast over the support frame, primed with 1200 Dow Corning primer, or it may be removed from the mold and either bonded to a support frame (not shown herein, but see Ser. No. 332,726 referred to above) with a silicone adhesive, such as General Electric RTV-700, or mechanically attached to such support frame. The support frame is generally a metal material with a centrally located circular hole from 3" to 24" in diameter. The membrane is mounted or molded to cover this circular hole. Upon attachment to the frame, the membrane may be stretched up to about 25% of its original size.

In the collector printing process, the membrane is held by a vacuum against a support or backing member when printed upon by a series of offset printing stations. After the print is completely formed upon the collector membrane surface, the support is removed, and a silicone pad moves through the hole in the support frame against the back (unprinted) side of the membrane, urging the membrane against the ware surface to be decorated. The decoration transfers from the membrane to the ware surface upon contact therewith.

The membrane thickness should be between about 0.020 and 0.200". The lower limit is the minimum thickness providing minimum acceptable mechanical strength. The upper limit is the maximum thickness providing minimum acceptable shape conformity. For example, intimate contact is required for total transfer from the membrane to the ware. In the case of ware shapes which have relatively abrupt contour changes, a membrane with a thickness beyond 0.200" would be too stiff to be conformed in a manner to prevent air from being trapped between the membrane and the ware (see U.S. patent application Ser. No. 332,723 referred to above.) The trapped air would then prevent the intimate contact. A preferred thickness range for membrane would be between 0.030" and 0.090".

The tensile strength and the elongation are measured in accordance with ASTM D-412. The preferred minimum values for tensile strength and elongation are 50 psi and 150%, respectively.

The most important property of a silicone membrane collector is its release characteristic. To function as both a receptor for ink and a donor of the same, the collector membrane must have a release characteristic within a certain range. Numerous attempts have been made to quantify such a property. Most attempts have not been found to be sensitive enough to differentiate between numerous transfer silicones. A test has been found for quantifying the surface release characteristics of RTV silicones as illustrated in the attached Tables II and III. The preferred equipment for the test is a model 80-2 Polyken Probe Tack Tester, manufactured by Testing Machines Inc., Amityville, N.Y. The test results in a probe tack reading which measures the force necessary to separate a metal probe from contact with the silicone surface. There is good correlation between the test and observed release characteristics. The test is far less influenced by the silicone durometer than other tests. In general the higher the tack value, the more affinity the silicone exhibits for pressure-sensitive inks of the type discussed in Ser. No. 419,196. Table II summarizes test parameters.

TABLE II

PARAMETERS OF POLYKEN PROBE TACK TEST FOR MEASUREMENT OF SILICONE SURFACE TACK*

| Parameter | Setting |
|---|---|
| Dwell Time | 1 sec |
| Separation Speed | 1 cm/sec |
| Probe Surface Area | .196 $cm^2$ |
| Temperature | 20° C. |
| Relative Humidity | 40% |
| Load | 1010 $gm/cm^2$** |

*Tack is reported as average of 10 readings on 3 samples. Samples are conditioned, after curing, in an environmentally controlled room for 24 hours prior to testing.
**1050 $gm/cm^2$ including sample and sample holder weight.

This test has demonstrated its accuracy, in that, many known silicone materials have been rated in the correct release order. Such correct order has been demonstrated through actual printing practices. For example, it is known that in order for an ink to transfer from one surface to another, the release characteristic of an ink carrying member must be greater than the same characteristic of the next surface against which the ink and the transfer member must be urged. In the past, the ease of release has been theorized to increase with decreasing surface energy. However, all silicones have relatively low surface energies, and among various silicones the ease of release has been found to correlate with surface tack measurements. Successive transfer from one surface to another is described in the aforementioned U.S. patent applications. Table III summarizes the characteristics of commercial RTV silicones:

TABLE III

CHARACTERISTICS OF COMMERCIAL RTV SILICONES

| Category of Release | Silicone[1] | Cure[2] | S.G.[3] | Durometer Shore A | % Rebound | Tack[4] | Tear Strength (psi) | Tensile Strength (psi) | % Elongation |
|---|---|---|---|---|---|---|---|---|---|
| High | DC 3110 | C | 1.17 | 44 | 68 | 124 | 20 | 330 | 150 |
| | GE RTV 602 | C | 1.00 | 23 | 70 | 62 | 10 | 100 | 200 |
| | GE RTV 11 | C | 1.18 | 45 | 74 | 83 | 15 | 350 | 180 |
| | SWS V-54 | C | 1.18 | 45 | 68 | 102 | 18 | 400 | 155 |
| Moderately | RTV 511 | C | 1.20 | 43 | 67 | 143 | 25 | 350 | 180 |
| High | SWS 04478 | C | 1.14 | 25 | 52 | 159 | 90 | 650 | 275 |
| | GE RTV 700 | C | 1.06 | 31 | 50 | 187 | 125 | 600 | 400 |
| | GE RTV 41 | C | 1.31 | 43 | 73 | 172 | 30 | 500 | 200 |
| | SWS 833 | C | 1.51 | 40 | 68 | 170 | 40 | 800 | 130 |
| Moderately | Silastic E | A | 1.12 | 42 | 60 | 312 | 90 | 700 | 400 |
| Low | GE RTV 615 | A | 1.01 | 37 | 57 | 444 | 25 | 900 | 150 |
| Low | Silastic L | A | 1.29 | 36 | 44 | 579 | 65 | 550 | 350 |
| | Silastic J | A | 1.29 | 50 | 50 | 514 | 70 | 750 | 175 |
| | GE RTV 630 | A | 1.28 | 63 | 46 | 537 | 85 | 800 | 420 |

[1]DC - Dow Corning Corp., Michland, MI
SWS - SWS Silicone Corp., Adrian, MI
GE - General Electric Co., Waterford, NY
[2]C - Condensation Cure
A - Addition Cure
[3]S.G. - Specific Gravity
[4]In grams as measured on a Polyken probe tack tester; 1010 $gm/cm^2$, 1 sec. dwell, separation speed 1 cm/sec, 20° C., 40–50% relative humidity.

For a collector silicone to properly function in a double offset (collector) process of the type described in U.S. patent application Ser. No. 173,129, it must exhibit intermediate ink affinity between the first offset silicone surface, and the ware or substrate surface being printed. Generally, silicones have good release characteristics and exhibit low affinities for most inks. A collector silicone, however, must be chosen to exhibit greater affinity for an ink than the first offset silicone printing onto the collector. In terms of the test, herein described, this means that the collector silicone must be chosen with a higher tack than the silicone used for the first offset surface, otherwise transfer onto the collector cannot occur.

The above is true for all inks. However, the absolute value of the required tack difference between the first offset surface and the collector, for consistent transfer between surfaces, is dependent upon the chemical nature of the particular ink employed. Some inks can transfer effectively between surfaces with a relatively small tack difference. Other inks may require a higher tack difference to achieve consistent 100% ink transfer. In no case, however, will a silicone, of a selected tack transfer an ink to another silicone of a lower tack.

In actual process operation, the surface tack of a silicone increases, or its release characteristic decreases, with repeated release cycling. Eventually, the silicone deteriorates to the point where complete transfer is not obtained, therefore, the process is no longer operable. At this point, the silicone surface must be replaced.

Patent applications and patents referred to herein are assigned to the assignee of the present invention and are considered to be incorporated herein by reference as necessary.

What is claimed is:

1. A collector membrane for receiving a thermoplastic, pressure-sensitive ink formulation in the form of a design by intimate contact with a surface carrying such design, and for depositing the design onto another surface by intimate mechanical contact therewith, comprising:

a membrane body formed of room temperature vulcanizing silicon material, said silicone material being formulated to have a tensile strength of at least 50 psi and an elongation of at least 150%, as measured in accordance with ASTM D-412, said membrane being between about 0.03" and 0.09" thick and being formulated from a silicone material including about 30 to about 50 parts per weight of dimethyl siloxane oil, said dimethyl siloxane oil having a viscosity between 20 and 1,000 centistokes, and said membrane having a hardness of about 50 to 75 points as measured on a shore-OO durometer gauge.

2. A silicone membrane as defined in claim 1 wherein said silicone material is formulated so as to exhibit a release characteristic of between 20 and 1200 grams from a probe loaded against the material at about 1050 grams/cm$^2$, with the probe having a surface area of about 0.196 cm$^2$, a dwell time of about 1 second, and a separation speed of about 1 cm/second, at a temperature of about 20° C. and a relative humidity of about 40%.

3. A silicone membrane as defined in claim 1 wherein said membrane is stretchable up to about 25% greater than its original size.

* * * * *